US009914042B2

(12) United States Patent
Chorne et al.

(10) Patent No.: US 9,914,042 B2
(45) Date of Patent: Mar. 13, 2018

(54) SPORTS GLOVE WITH PROTECTIVE INTERIOR BARRIERS FOR FINGERTIPS AND WRIST

(71) Applicants: Robert Chorne, Freeport, NY (US); DJPZ HOLDINGS LTD., Freeport, NY (US)

(72) Inventors: Robert Chorne, Freeport, NY (US); Michel Ferland, Quebec (CA)

(73) Assignee: Robert Chorne, Freeport, NY (US)

( * ) Notice: Subject to any disclaimer, the term of this patent is extended or adjusted under 35 U.S.C. 154(b) by 0 days.

(21) Appl. No.: 15/203,621

(22) Filed: Jul. 6, 2016

(65) Prior Publication Data

US 2016/0310823 A1 Oct. 27, 2016

Related U.S. Application Data

(63) Continuation-in-part of application No. 15/184,411, filed on Jun. 16, 2016, which is a continuation of application No. 14/795,488, filed on Jul. 9, 2015, now Pat. No. 9,375,036, which is a continuation-in-part of application No. 14/337,565, filed on Jul. 22, 2014, (Continued)

(51) Int. Cl.

| | |
|---|---|
| ***A63B 71/14*** | (2006.01) |
| ***A41D 19/015*** | (2006.01) |
| ***A41D 13/08*** | (2006.01) |
| *A41D 19/00* | (2006.01) |

(Continued)

(52) U.S. Cl.

CPC ..... *A63B 71/143* (2013.01); *A41D 13/084* (2013.01); *A41D 13/087* (2013.01); *A41D 19/001* (2013.01); *A41D 19/01523* (2013.01); *A41D 13/085* (2013.01); *A41D 19/0044* (2013.01); *A41D 19/0048* (2013.01); *A41D 2300/322* (2013.01); *A41D 2600/10* (2013.01); *A63B 2102/14* (2015.10); *A63B 2102/24* (2015.10); *A63B 2209/10* (2013.01)

(58) Field of Classification Search

CPC .... A41D 13/08; A41D 13/081; A63B 71/143; A63B 71/14

See application file for complete search history.

(56) References Cited

U.S. PATENT DOCUMENTS 2,451,837 A * 10/1948 La Londe ..... A41D 19/01 2/158
4,773,100 A * 9/1988 Kuo ..... A41D 3/06 2/159

(Continued)

*Primary Examiner* — Shaun R Hurley
*Assistant Examiner* — Andrew W Sutton
(74) *Attorney, Agent, or Firm* — Alfred M. Walker

(57) ABSTRACT

A sports glove such as those for hockey, lacrosse, cricket, baseball and the like is formed as a palm and a separate back with a continuous peripheral closure for attachment of the two parts. The fingers inside the finger stalls are protected from contact with the closure material which is typically a metallic or plastic zipper, wherein carefully proportioned padding inside the finger stalls insulates each finger side and distal end from contact with the closure thus offering adequate protection. Furthermore, a pivotable inside wrist cuff flap is provided which creates a smooth transition of inside glove liner material protecting the palm and inside wrist from contact with hook and loop closure materials in the area as the hand is inserted into the glove.

22 Claims, 14 Drawing Sheets

Related U.S. Application Data now abandoned, which is a continuation-in-part of application No. 13/689,349, filed on Nov. 29, 2012, now abandoned.

(51) Int. Cl.
*A63B 102/24* (2015.01)
*A63B 102/14* (2015.01)

(56) References Cited

U.S. PATENT DOCUMENTS

| | | | | | |
|---|---|---|---|---|---|
| 5,020,161 | A * | 6/1991 | Lewis, Jr. | A41D 19/01529 | 2/159 |
| 5,329,639 | A * | 7/1994 | Aoki | A63B 71/143 | 2/16 |
| 5,699,632 | A * | 12/1997 | Stout | A41D 19/01 | 2/158 |
| 6,338,163 | B1 * | 1/2002 | Markson | A41D 19/0017 | 2/161.6 |
| 2004/0064870 | A1 * | 4/2004 | Gold | A41D 19/01 | 2/158 |
| 2014/0359916 | A1 * | 12/2014 | Baunach | A41D 19/0017 | 2/163 |

* cited by examiner

Fig. 19
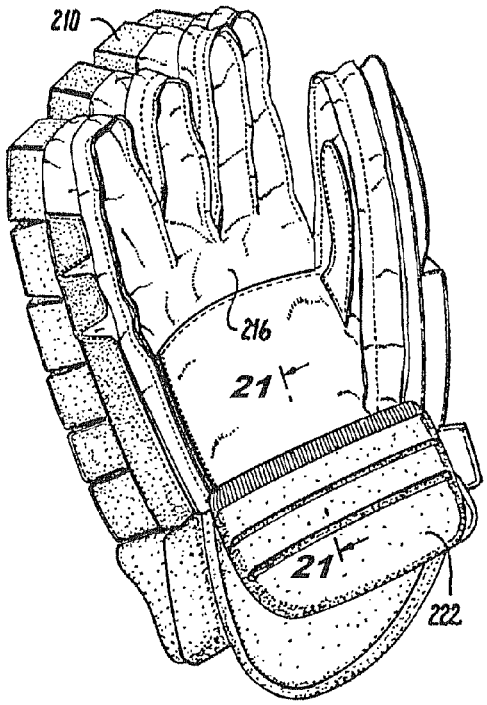
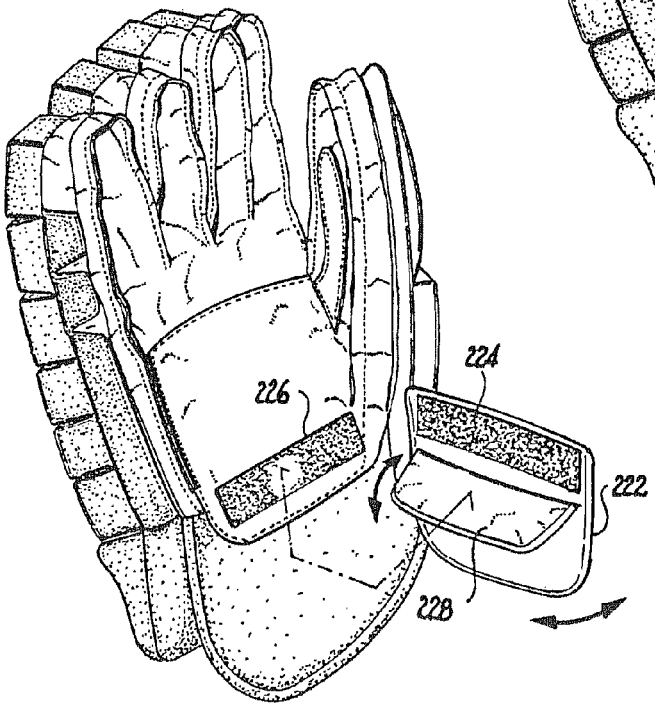
Fig. 20
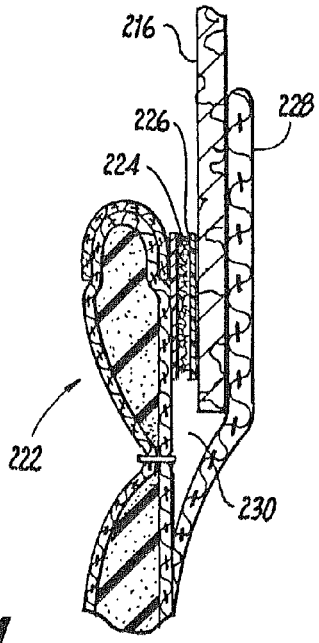
Fig. 21

SPORTS GLOVE WITH PROTECTIVE INTERIOR BARRIERS FOR FINGERTIPS AND WRIST

RELATED APPLICATIONS

This application is a continuation-in-part of application Ser. No. 15/184,411, filed Jun. 16, 2016, which '411 application is a continuation of application Ser. No. 14/795,488, filed Jul. 9, 2015. The '488 application is a continuation-in-part of application Ser. No. 14/337,565, filed Jul. 22, 2014. The '565 application is a divisional and continuation-in-part of U.S. patent application Ser. No. 13/689,349, filed on Nov. 29, 2012, and claims priority in part under 35 U.S.C. § 120 therefrom. This application also claims priority from Patent Cooperation Treaty patent application PCT/US2013/072021, filed Nov. 26, 2013, and claims priority in part therefrom. These applications are incorporated by reference herein.

FIELD OF THE INVENTION

The present invention relates to a protective glove for sports, specifically in which the front and its palm area portion, which is used for holding the sport stick apparatus, can be removed and replaced quickly efficiently without the fingertips feeling the zipper materials on the internal finger stall region.

BACKGROUND OF THE INVENTION

Prior Art

In a sports glove, such as a hockey glove, the portion on the back of the glove is usually protected with encapsulated internal padding covered with durable material and is less susceptible to damage and wear during conventional use. The front palm portion of the sports club incurs wear and tear to a much greater extent during use due to friction from the constant engagement with the sport stick. Consequently the front palm area of the sports glove is more likely to abrade and tear, or get brittle than the back of the glove.

U.S. Pat. No. 5,329,639 A to Aoki discloses a hockey glove which addresses some of these issues. The hockey glove of Aoki discloses a back member covering the back of the uses hand and having the exterior surface of the back member covered with padding. A removable front palm portion is attached to the back member by a zipper.

The Aoki '639 patent suffers from the disadvantages of providing a connecting zipper which may be abrasive when in contact with the finger tips of the user, while the fingers of the user are in the finger stalls formed by the joining of the rear back portion of the sports glove to the front palm portion thereof.

OBJECTS OF THE INVENTION

An object of the present invention is to overcome the aforementioned drawbacks of the prior art.

Additionally, an object of the present invention is to provide a sports club with a quick and economical palm area replacement with comfortable internal padded finger stalls.

Additionally an object of the present invention is to provide a pivotable inside wrist cuff flap that allows attaching internal flap walls in the internal glove portions as a smooth transition into the back area of the glove's palm portion.

SUMMARY OF THE INVENTION

Although the prior art does reveal sports gloves such as those for hockey, lacrosse, cricket, baseball and the like which are formed as a palm and a separate back with a continuous peripheral closure for attachment of the two parts, the fingers inside the finger stalls are not sufficiently protected from contact with the closure material which is typically a metallic or plastic zipper. In the present invention, carefully proportioned padding inside the finger stalls insulates each finger side and distal end from contact with the closure thus offering adequate protection.

Furthermore, focusing on the wrist area there is another region where abrasion can be avoided. A pivotable inside wrist cuff flap is provided which creates a smooth transition of inside glove liner material protecting the palm and inside wrist from contact with closure materials in the area as the hand is inserted into the glove.

The present invention is also a new improved version of a two piece, connector joined sports glove, such as hockey, lacrosse and other sports gloves. The sports glove of the present invention features a joining connector, such as a zipper, set of snaps or other suitable attachment, covered by a fly cover. The zipper attaches the front palm with fingers portion to the glove portion. The fly cover protects the zipper attachment from damage caused by impact from the sports mentioned and protects the players in these sports from exposed zippers.

The present invention also describes a method of joining the front and back of a sports glove (hockey, lacrosse, cricket, baseball and the like), utilizing a zipper attached to the front and back portions. whereby the zipper is engaged to form at least the upper finger stalls and the palm of the sports glove. The zipper is covered with a panel or fly cover thereby protecting the user, participant player(s) from skin contact with an exposed zipper. The method further includes joining the front and back of the sports glove (hockey, lacrosse, cricket and the like), utilizing a connector attached to the front and back portions. whereby the connector is engaged to form at least the upper finger stalls and the palm of the sports glove. To protect the skin and/or face of both opposing participant players, and the participant himself or herself, this connector is covered with a panel or fly cover thereby protecting the user, participant player(s) from skin contact with an exposed connector.

This development also leads to a better feeling glove with more comfort, a normal look and a non exposed zipper. The fly cover can be the same material as the front palm-finger area or it can be different material. It can also be a combination of materials. It can be made of any suitable material used to make gloves or a combination of any suitable material or materials.

In the preferred embodiment the fly cover can match the finger material or it can be different. The fly cover can be part of the front palm-finger portion in the sports glove such as hockey and lacrosse and the like. The fly cover can go from the glove portion (side) to the front palm side to cover the zipper. The fly cover can be a combination of the glove side and the front palm-finger side portions. The fly cover can be from the front palm side of the glove portion (side) to the glove portion. The percentage of each can be any percentage that can be feasible if one uses a combination of glove and front palm portions to form the fly cover.

The fly cover can be different directions on different parts of the gloves if desired. The fly can overlap the nearest material that it is trying to meet. The fly can also be just shy of meeting the material it is trying to meet.

The preferred embodiment would have the fly-cover cover the zipper as much as possible. Other embodiments may have less than the full coverage; however, anything covering at least 50 percent of the zipper would be preferable.

The fly cover can go from left to right or right to left or any combination of these. The fly cover can go up to down or down to up or any combination of these. The fly cover can be any direction or a combination of directions. The fly cover can be any suitable material or a combination of suitable materials.

The zipper can be made of any suitable material or materials. Examples include plastic, nylon, synthetic, polymer materials, metal, ferrous or non ferrous material, carbon fiber or any suitable material or combination of materials. The fly can be made from any suitable material or a combination of materials. The fly can be made from one piece of material or it can be made of multiple pieces.

The fly cover material can be fabric type material, either synthetic or natural, such as leather, synthetic leather, suede, synthetic suede, Nash, micro fiber type material, VELCRO® hook and loop fastener, any natural or synthetic material or combination of materials and fibers that can be used in this industry for gloves. The fly cover can be any color or combination of colors.

The zipper can be made from any suitable material or combination of materials. The fly can be cut, formed, molded, cast, forged, pressed, sewn or use any known manufacturing method or methods to make it.

The zipper can be made from any suitable material or combination of materials. The zipper can be sewn, molded, pressed, cast, forged, formed, cut or be made by any known manufacturing method or combination of methods or manufacturing techniques. The attachment of the zipper and fly cover can be sewn, glued, bonded or use any suitable bonding technique or any combination of techniques.

The zipper can be installed on the front palm unit in any feasible position-possible position. The preferred embodiment would have the zipper teeth at least slightly away from the back of the front palm units-finger receptacle edges.

The zipper attachment on the glove side can be installed toward the middle of the fingers, toward the back of the fingers or toward the front of the fingers or any feasible position that will allow the operation and comfort for the fingers. On the preferred embodiment, the continuation of the zipper toward the sides of the hand and cuff would be toward the outer portion of the glove unit. The preferred embodiment would have some material between the edge of the finger unit and the zipper.

The connector (i.e. zipper) is provided in a closed position during use of the glove during game play, and that the connector is continuously covered by a fly cover, which clasps and extends closely over the connector, during use of the glove during game play, whereby said connector is not exposed to the skin of a sports game participant wearing the glove or to the skin of a sports game participant not wearing said glove.

The fly cover is sewn in place to the front palm portion and/or said back glove portion, and the fly cover clasps and extend closely over the closed zipper during use of the glove during game play, without any attachment other than friction.

The zipper is in a position and protected so that it doesn't interfere and that the zipper and fly cover extend around the undulating periphery of the joined front and back portions of the hockey glove. Therefore, the fly cover clasps and extends closely over the zipper. There is no gap that would interfere with the protection of the zipper under the fly cover.

Without the friction fit of the fly cover, the whole cover would fall once peeled away during an active contact sport.

The sports glove, used in a sports event by a sport participant holding an item during game play, includes:

a) a front palm portion having finger stalls for insertion of fingers therein;

b) a back glove portion attachable to said front palm portion by a connector, in a closed position during use of the glove during game play; and c) said connector continuously covered by a fly cover clasping and extending closely over said connector during use of the glove during game play;

d) wherein said closed connector and said fly cover extend in a continuous peripheral non-linear serpentine line of varying radii around each finger stall and/or thumb stall and side of hand leading toward the cuff on the glove portion and each finger stall and thumb stall and side of hand leading to said cuff on said front palm portion during use of the glove during game play;

e) whereby said connector is not exposed to the skin of a sports game participant wearing said glove or to the skin of a sports game participant not wearing said glove.

In an alternate embodiment for a zipper attached sports glove, such as a cricket glove, where a separate thumb stall protrudes from a surface of the palm portion of the sports glove, and is therefore not connected to a zipper or other connector.

BRIEF DESCRIPTION OF THE DRAWINGS

The present invention can best be understood in connection with the accompanying drawings. It is noted that the invention is not limited to the precise embodiments shown in drawings, in which:

FIG. 19 is a perspective view of a sports glove of this invention with a further alternate embodiment for a wrist cuff extension attached.

FIG. 20 is a perspective view of the sports glove of FIG. 19, with the wrist cuff extension removed and juxtaposed, to show its underside with a hook and loop attachment strip and pivotable flap.

FIG. 21 is a side cross sectional detail view showing the position of the pivotable flap of the sports glove of FIGS. 19 and 20, prior to hand insertion, thereby protecting the hand and wrist from any rough edges and closure contact.

Figure 1:
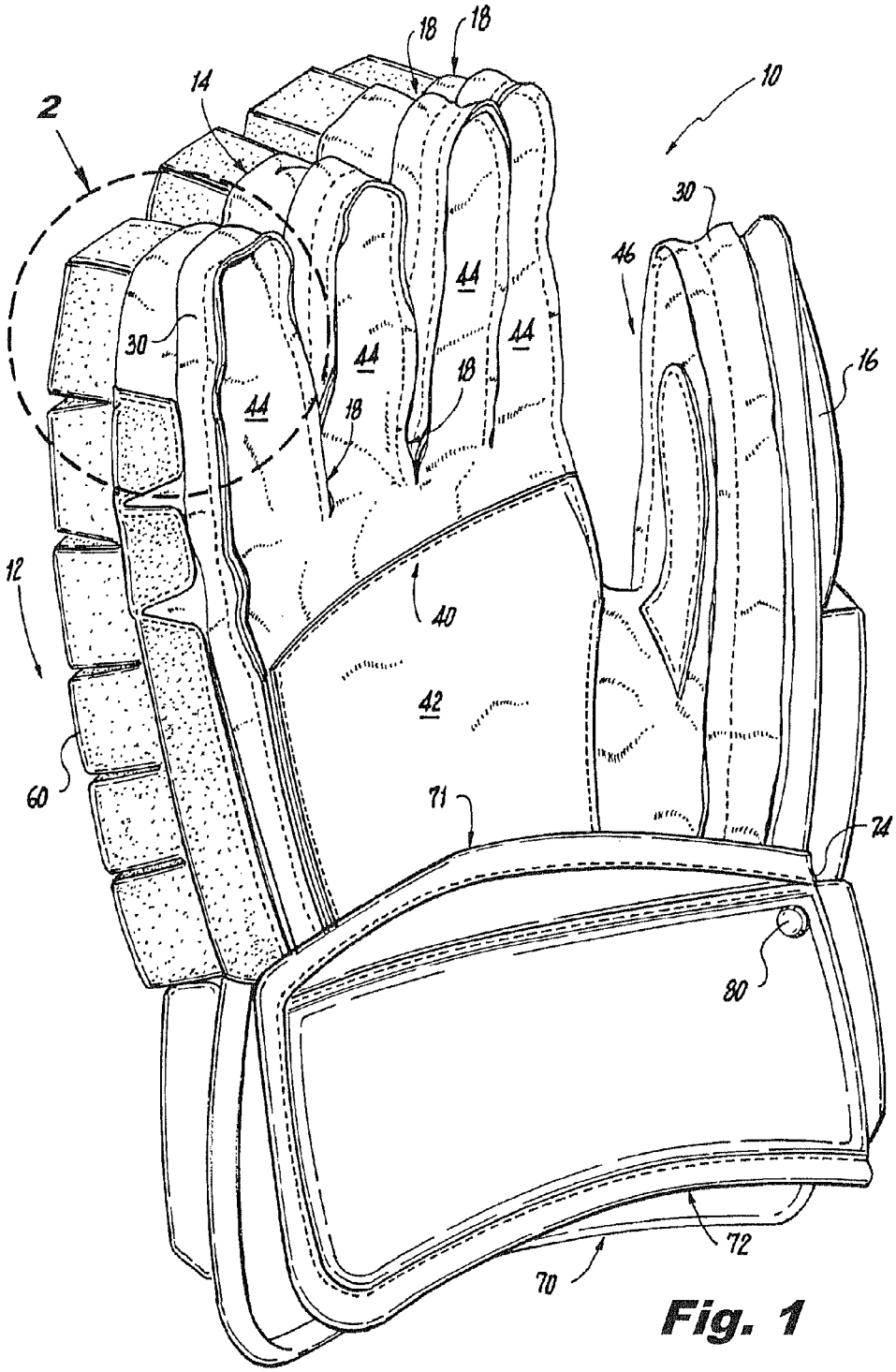
FIG. 1 is a front perspective view of the zipper attached sports glove with fly cover protection of the present invention.

The stippling in the drawings represents texture.

DETAILED DESCRIPTION OF THE INVENTION

The present invention provides a hockey glove, lacrosse glove, sports gloves, with an easily replaceable front palm-finger unit while protecting the attachment means.

The hockey glove 10 includes a back member 12 having a body portion 14, a thumb portion 16 and a plurality of finger portions 18. Padding members 60 are permanently internally encapsulated within the glove to protect the fingers, thumb, back and side portions of the glove and the cuff area 70, thereby protecting the user's hand. A plurality of internal changeable front member units 40 is provided with each front member including a front palm portion, a thumb portion and a plurality of finger portions. The number of finger portions of the front member unit 40 corresponds to the number of finger portions in a corresponding back member in the preferred embodiment. There can also be a different number of finger elements or socket or receptacle from one to five, however, the preferred would match as stated.

An attaching means removably couples one of the front members to the back member.

The coupled front and back members cooperate to form a hand receiving portion which includes a palm, thumb stall and a plurality of finger stalls.

The hockey and lacrosse gloves and sports gloves of the present invention include the glove to the users' hand and wrist area. The protective element for the wrist area is known as the cuff 70 and 72 in FIG. 1. A wrist cuff closure mechanism for securely and easily fastening is provided.

The wrist cuff includes a back portion 72 attached to the glove side and the front portion 70 which is attached to it as a continuation from the glove portion 72. The wrist cuff is not fully sewn to form a continuously closed cuff around its perimeter. There is an open portion, so the cuff is not permanently closed. It allows the cuff to open and close. The two or more parts of the cuff have hinged action from the sewing or attaching the parts together while not permanently attaching the opposite side to the gloves back portion. The closure mechanism may include VELCRO® hook and loop type fasteners, and snaps or any other workable attachment means. The preferred closure has a VELCRO® hook and loop type fastener on the base of the palm at the wrist area and opposite on the cuff side 71. These two areas coincide to form the attachment at these locations across the lower region of the palm area that meets it. The cuff only requires one snap 80, which securely fastens the cuff together so it can't open easily in play. The snap is at the end or toward the end of the open portion, two parts that need to be joined to close the cuff. The snap has a male portion and a female portion, the male and female portion are positioned to meet from the two portions that are needed to close the cuff area. FIG. 1 represents the area for the snap at reference numeral pairs 80, 74 or 80, 72 or a location in this area as described.

The back glove unit 12 will have the matching portion of the zipper attachment 22, as shown in FIG. 1, so the palm unit 40 with palm portion 42 can be joined with the back glove unit 12 to form a hand receiving sports glove unit 10 according to the present invention.

Detailed Description Of The Preferred Embodiments

The hockey or lacrosse glove 10 of the present invention includes a back member 12, shown in FIG. 1, which covers the back of the user's hand. The back member includes a body portion 14, a thumb portion 16 and four finger portions 18, although it should be noted that the glove may be formed with less than four finger portions 18.

The zipper 20 connects the front palm portion 42 of the sports glove 10 with the rear portion 12 of the sports glove 10. The zipper 20 is covered by a fly cover 30 wherein the zipper 20 and the fly cover 30 extend in a continuous peripheral non-linear serpentine line of varying radii around each finger stall 44, thumb stall 46 and side of hand leading toward the cuff 70 on the rear glove portion and each finger stall 44 and thumb stall 46 and side of hand leading to the cuff 72 on the palm portion 42.

Padding 60 is encapsulated between the body portion 14 and back portion 12 to protect the exterior side of the back member 12 and it substantially covers the exterior portion of the back member 12 to protect the user's hand. The padding 60 may be in the form of foam inserts into the areas needed to be protected such as the fingers and back of hand and side of hand and cuff area. The padding may also be in the form of a plurality of rolls, some of which extend across the back of the hand, generally on the back of the body portion 14. Other of the rolls may be positioned longitudinally along the back area of the finger portions 18. Similarly, another padding roll or insert may be provided which corresponds to the shape of the thumb portion 16. Thumb portion 16 may also have a plastic insert along with foam padding adding further protecting the thumb. Additionally the padding may be tapered and or have any shape desired.

Figure 5:
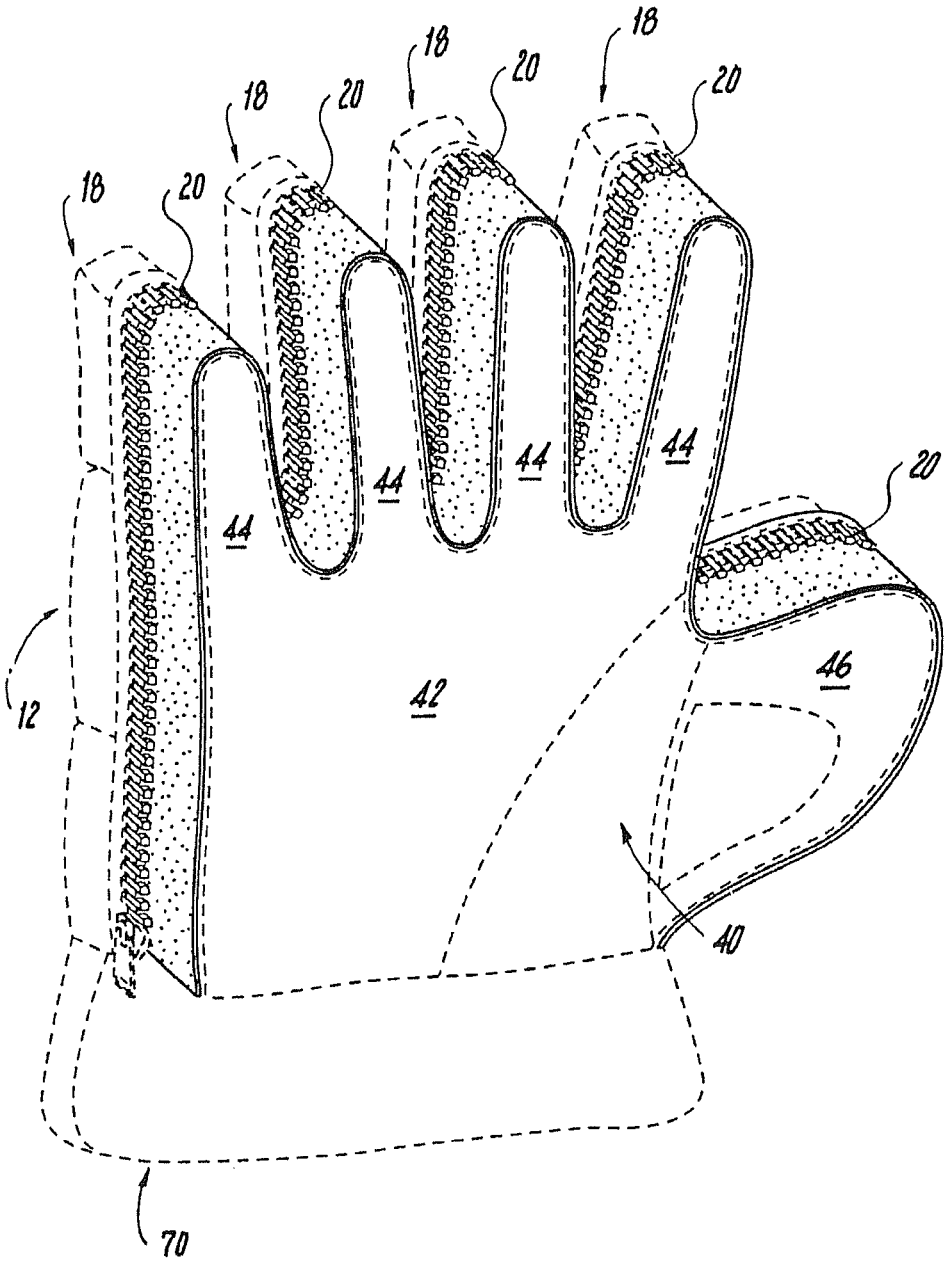
FIG. 5 is a front perspective of another embodiment for one hand of a pair of a zipper-attached front palm units according to the present invention.

The removable front palm unit 40, shown in FIG. 5, covers the front portion of the players' hand. A plurality of front finger members 44 may be provided for use with a single back member 12. Each removable front palm units 40 includes a palm portion 42, a thumb portion 46 and four finger portions 44. The thumb portion is usually stitched to the remainder of the front palm portion. Fewer finger members 44 may be formed limited only in that the number of finger portions 44 of the front palm unit 40 is intended to correspond with the number of finger members 18 of the back member 12. The front palm unit can be any thickness desired or any material desired or any combinations of material desired. It is contemplated that a plurality of front palm units with varying thicknesses and or materials can be attached to the same back member 12. However, it is preferred that the front palm unit 40 have a thickness that allows greater feel by the player. This can be achieved using the desired material and thickness for the particular material.

The size and material provide an effective hockey and lacrosse glove which maintains the appropriate flexibility and control for the player. Front palm unit may terminate at the very bottom of the wrist area. VELCRO® hook and loop type fastener or another closure material or device can be stitched to the base of the front palm unit to aid in the cuff closure. As shown in the accompanying drawings, the back member 12 and front palm unit 40 are attached together by a closure, such as a zipper 20 on the front palm unit and 22 on the glove unit, covered by fly 30 from front to back or fly 32 from back to front or fly 34 which forms in the middle to form a hand receiver portion which includes a thumb stall and a plurality of finger stalls. The zipper and fly extend around each finger and thumb unit and side of hand leading toward the cuff on the glove side and each finger and thumb and side of hand leading to the cuff on the palm side. Additionally the zipper and fly cover extend along the thumb 16 on the glove portion and 46 on the palm unit and finger portions 18 on the glove portion and 44 of the front palm unit, thereby connecting the front palm unit to the back member 14 forming a hand receiving unit. The zipper is preferably a thin, narrow, soft zipper with a lock, thereby allowing the zipper 20 on the front palm unit and 22 on the glove unit to effectively operate in the space provided between the finger walls and also the fly cover.

The hockey and lacrosse glove or sports glove 10 of the present invention includes a wrist closure mechanism for securely fastening the glove at the users' wrist. The wrist closure mechanism includes a first flap 70 attached to one side of the of the body portion 14. A hook and loop type fastener such as VELCRO®, is attached to the interior of flap 70 at or near the inside horizontal area at 71. Additionally a snap 80 or other closure devise is attached to the flap 70. The female portion of the snap can be on the inside of this flap.

A second flap 72 can have the male portion which coincides with the snap on flap 70. The preferred embodiment would have the male portion on the glove side next to the base of the zipper 74 attachment on the side of the glove. Near this area on the glove side can have the male portion of the snap. This may also be reversed to allow 72 or 74 to have the male side of the snap and the inside of flap 70 have the female portion to receive. The preferred embodiment would have the female portion of the snap on the 70 flap and the male portion of the snap on position 74. The exterior side of the front palm unit base would also have VELCRO® hook and loop type fastener which coincides to the shape and size on the first flap at 71 for closure purpose. The snap or other closure devise is for a secure closure.

In operation the wrist closure operates as follows:

With or without the players hand in the glove 10, the first flap 70 secures the VELCRO® hook and loop fastener on the inside of flap 70 coinciding with to the palm units VELCRO® hook and loop fastener type of attachment at coinciding areas or points as it closes and the snap 80 locks the cuff unit secure on position 74.

The zipper 20 on the palm unit and 22 on the glove portion is protected by the fly cover 30 which goes from front to back, or 32 which goes from back to front or 34 which goes in both direction toward the middle, allows for quick and easy replacement of the front palm unit 40. The fly cover can be a combination of any direction from the palm unit or the glove portion or be any combination of the two. It can even be different ways of covering the zipper in different sections of the glove or palm unit. The zipper is in a position and protected by the fly cover so that it does not interfere with the operation and use of the hockey or lacrosse glove or other sports glove 10. The zipper and fly cover extend around the portions of the players hand and fingers in which the hand fits into. The present invention allows a single back member 12 and a plurality of front palm units 40, thereby extending the life and usefulness and function of the glove 10.

Another embodiment may have a gap between the base of the palm unit and cuff area. On this glove the cuff will not overlap the palm unit. There can be a gap between the cuff and the palm unit. The tab on the bottom of the zipper on each side may be covered by a piece of material coining off the glove or as part of the replaceable palm or a combination of both.

This embodiment allows more freedom for the wrist to maneuver while having a replaceable palm unit.

Figure 2:
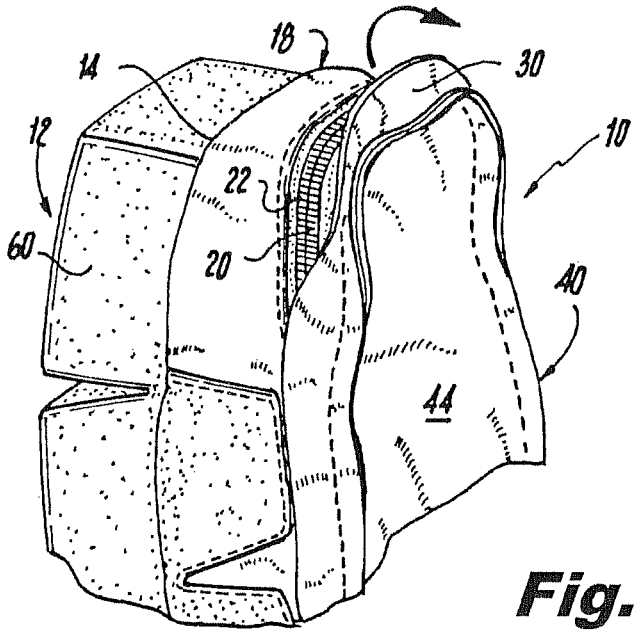
FIG. 2 is a close up detailed view thereof.
Figure 3:
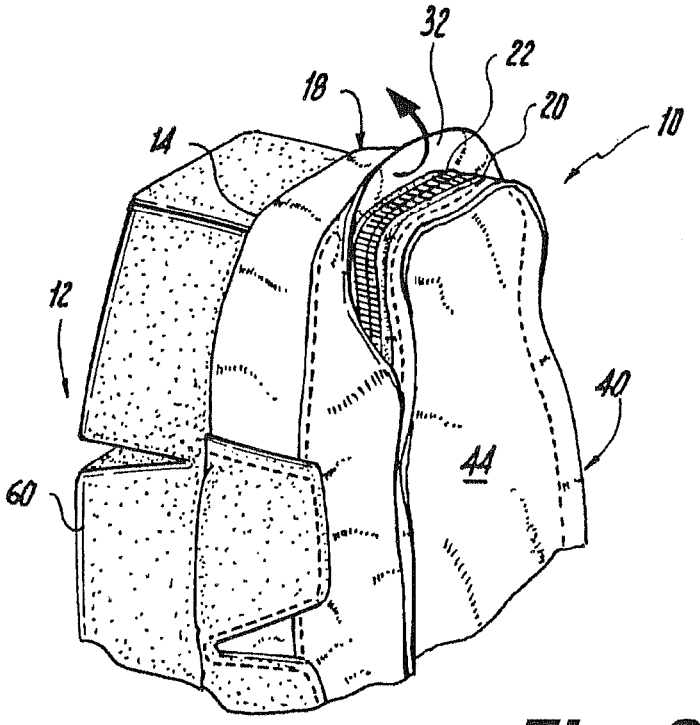
FIG. 3 is a close up detailed view of an alternative embodiment thereof.
Figure 4:
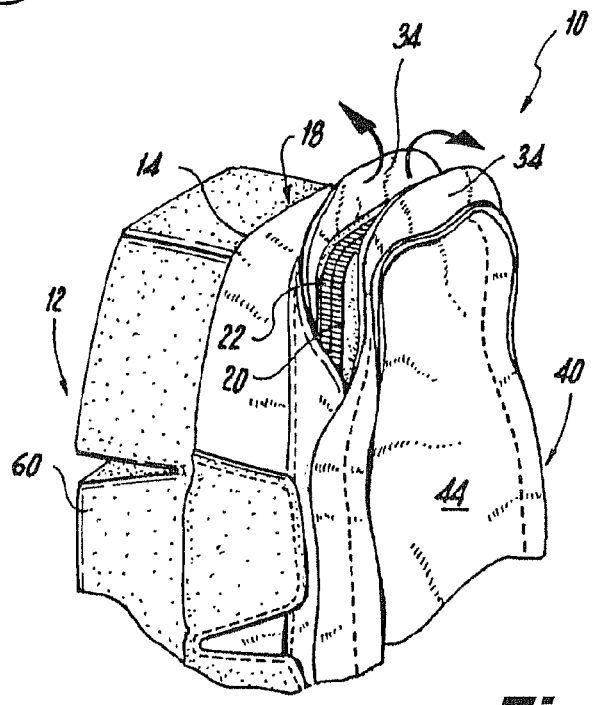
FIG. 4 is a detailed view of a further alternative embodiment thereof.

Another embodiment is a replaceable front palm unit 40 which has a zipper attachment 20 as shown in FIG. 2 and a fly cover 30, 32, 34 as shown in FIGS. 2, 3 and 4. The fly cover may be only a portion of a fly cover to cover the zipper attachment or cover a portion of the zipper attachment on the front palm unit. The fly cover may be able to cover the majority or even most of the zipper if not all of the zipper attachment on the front palm unit. Whatever percentage is needed or works best would be alright as the desired results are achieved. The front palm unit has a palm section, a thumb section and a plurality of finger portions which will coincide with the glove portion to form a hand receiving unit. The base of the front palm unit may have VELCRO® hook and loop type fastener to aid in the cuff closure when the palm of the glove is in the glove unit. There may be any number of finger portions or hand shapes—make up to any desired form to form a hand receiving unit. The fly cover may be any portion of the total fly cover and can vary in thickness and shape or size or length if desired or be consistent if desired or any combination of percentages within the replaceable palm unit.

On the preferred embodiment, the snap would be on the cuff flap 70 with the female portion being exposed on the inside of the cuff flap toward the end of the flap as shown on FIG. 1. The base of the side of the glove side opposite the cuff flap would have the male portion of the snap 74 as shown in FIG. 1. This would be next to the palm units' zipper attachment's zipper. The snap could then be closed and secured from the wrist cuff flap to the glove side.

FIG. 2 is a detailed close up view of the glove portion containing a portion of the zipper 20 from the palm unit and 22 from the glove unit. Fly cover 30 on the front palm unit covers both elements of the zipper attachments from the front palm unit and the glove unit. The fly cover is attached to the front palm unit and is made with material that is sewn and part of the front palm unit, thereby protecting the zipper attachment. The direction of the fly cover is from front palm unit towards glove unit. FIG. 2 shows a partially peeled away view. The part of the fly cover 30 that is not peeled away covers the zipper 20, grasping and closely extending over the zipper 20 without any attachment other than friction. The zipper 20 is protected by the fly cover 30, which clasps by friction and closely extends over the zipper 20. Without the friction fit of the fly cover 30 over the zipper 20, the fly cover 30 would fall away during vigorous use of a contact sports game, such as ice hockey.

FIG. 3 is a close up view of an alternative embodiment. On this embodiment the fly cover 32 is part of the glove unit. The zipper 20 from the front palm unit attaches to the zipper 22 on the glove unit the fly cover 32 covers the zipper attachment as shown and describes with material that is attached to the glove unit. This protects the zipper attachment.

Figure 3A:
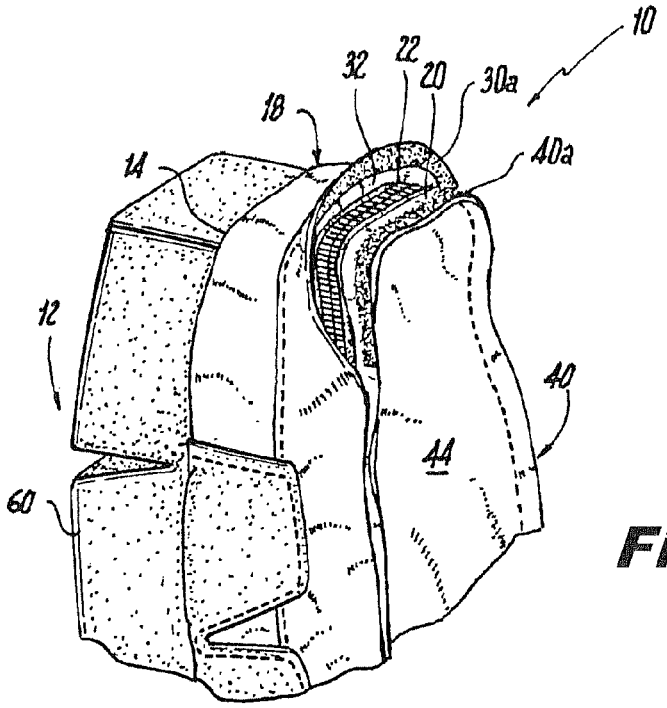
FIG. 3A is a close up detailed view of another alternate embodiment thereof.

FIG. 3A is a close up view of a further alternate embodiment where the fly cover 32 can have a thin peripheral edge of a friction attachment, such as an elongated strip 30*a* of a hook and loop VELCRO® fastener material, which is joinable to a reciprocal strip 40*a* of hook and loop VELCRO® fastener material located on the glove surface immediately adjacent to the zipper 20 portion, so that the friction attachment 30*a*, 40*a* overlays and extends beyond the zipper 20.

FIG. 4 is a close up view of a further embodiment. This shows the zipper 20 from the palm unit joins zipper 22 from the glove unit. The fly cover 34 has material from both the palm unit and the glove unit. The fly cover covers the zipper attachment and protects the zipper.

Another embodiment can have any combination of the above embodiments where the material used for the fly cover can come from either or both the front palm unit or glove unit or both. There can be another embodiment that has varying areas around or near the zipper portion were the material can come from one side or the other or both.

FIG. 5 is a front perspective of a zipper attached front palm unit 40 according to the present invention. This view shows the majority of the zipper element 20 as it goes from the side of the hand closest to the cuff 70, around the plurality of finger elements 44 and around the thumb area 46 on the front palm unit 42.

Figure 6:
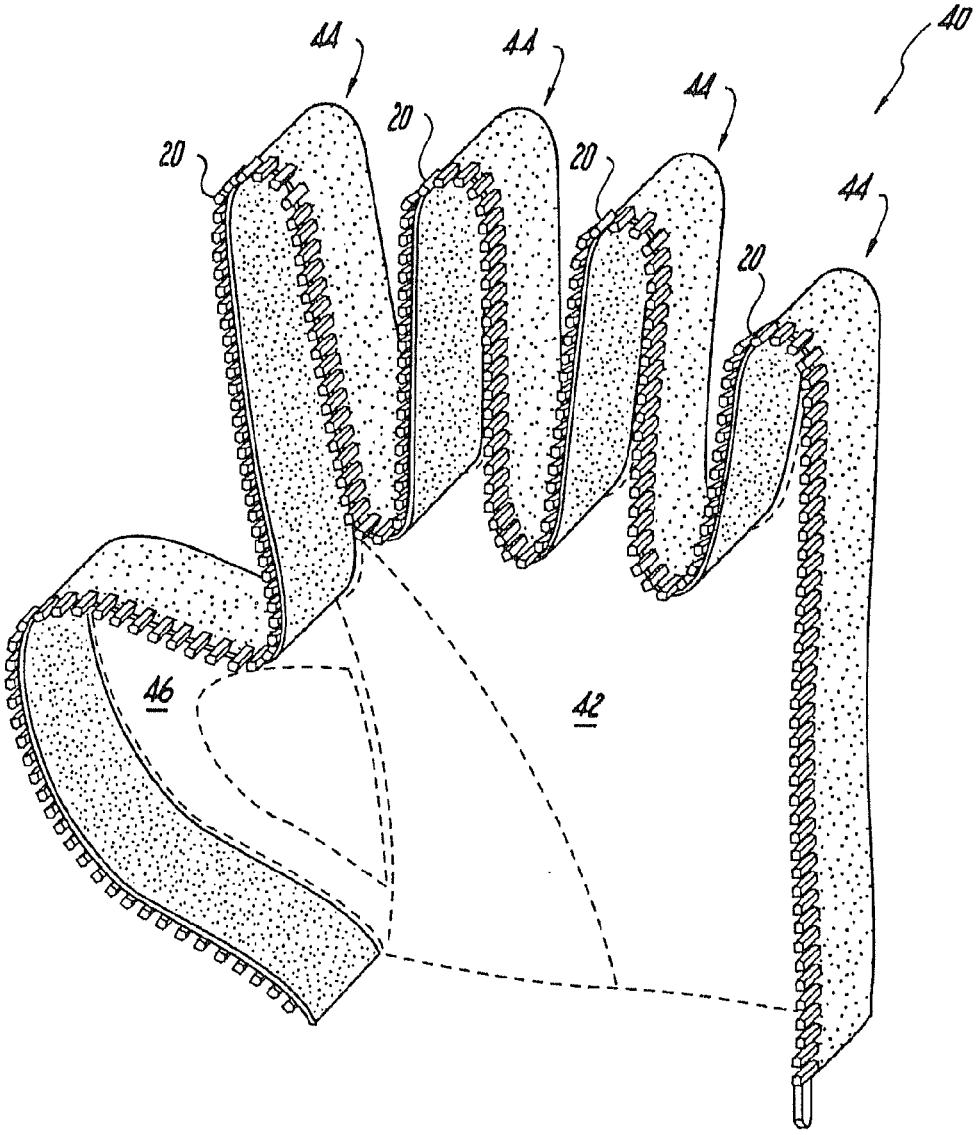
FIG. 6 is a rear perspective view thereof.

FIG. 6 is a rear perspective view of another embodiment for the zipper attached front palm portion 42 of a pair of front palm and back glove portions 40 and 12 respectively of sports glove 10 according to the present invention. This view shows how the zipper 20 goes from the side of the hand portion closest to the base of the unit continuously up toward and around each finger unit 44 and around the thumb member 46.

Figure 7:
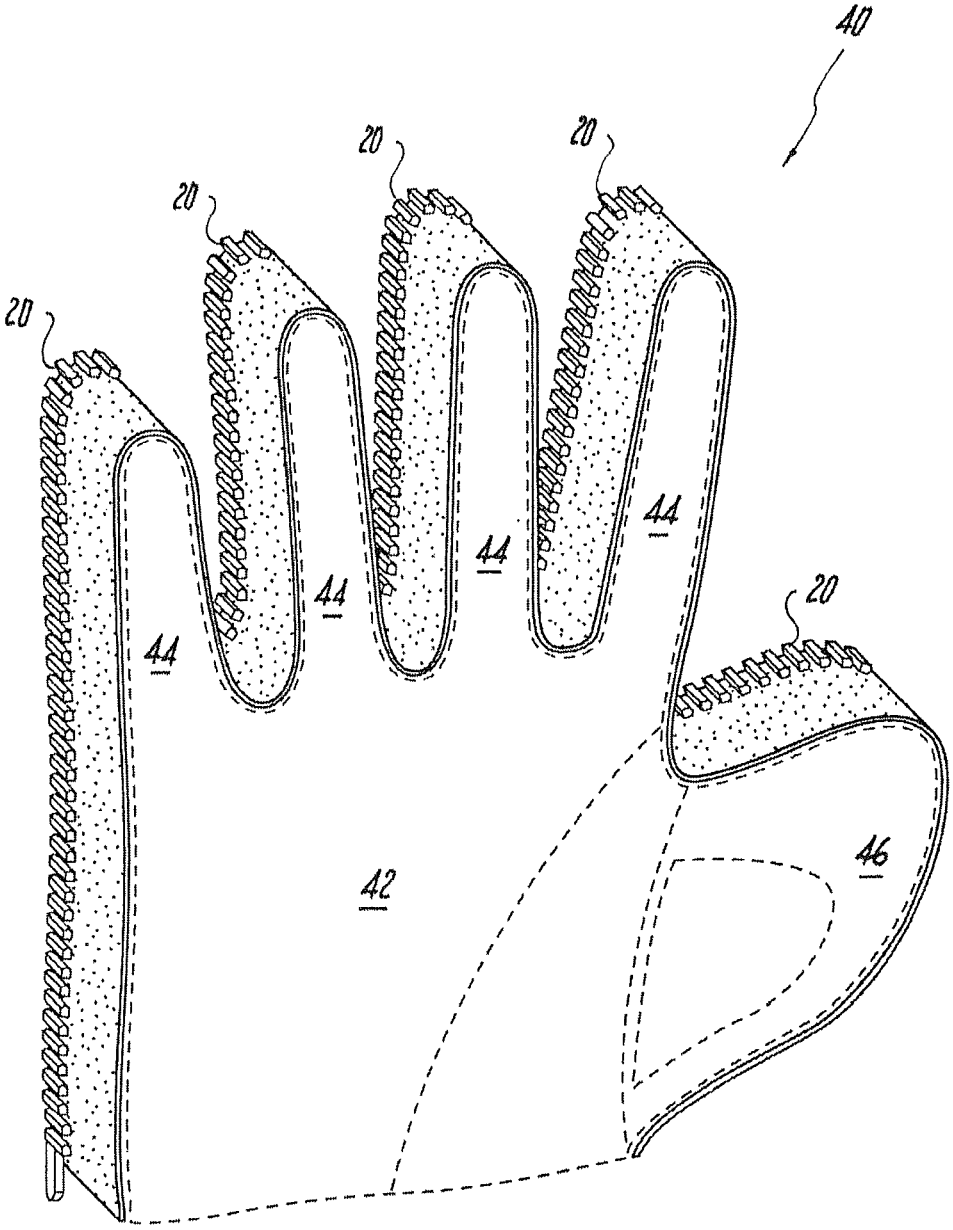
FIG. 7 is a front perspective view thereof.

FIG. 7 is a front perspective of a zipper attached front palm unit 42 according to the present invention. This view shows the majority of the zipper element 20 as it goes from the side of the hand closest to the cuff, around the plurality of finger elements 44 and around the thumb member 46 on the front palm unit 40.

Figure 8:
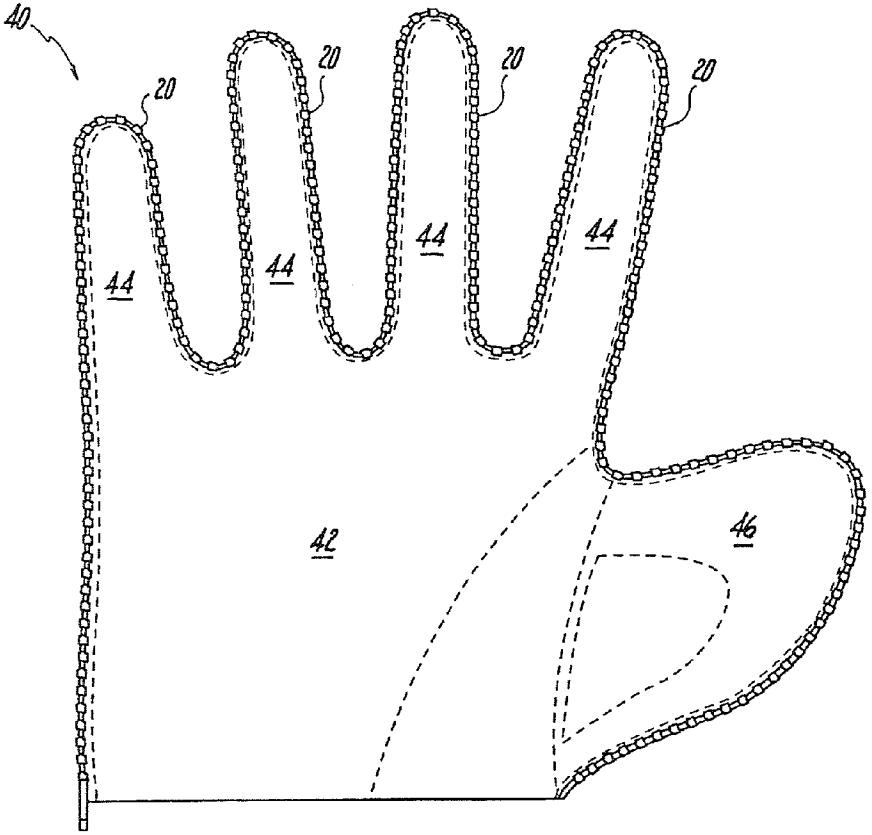
FIG. 8 is a rear elevational view thereof.

FIG. 8 is a rear elevational view of the front palm unit 42 of this invention. The zipper element 20 goes completely around the palm portion's periphery.

Figure 9:
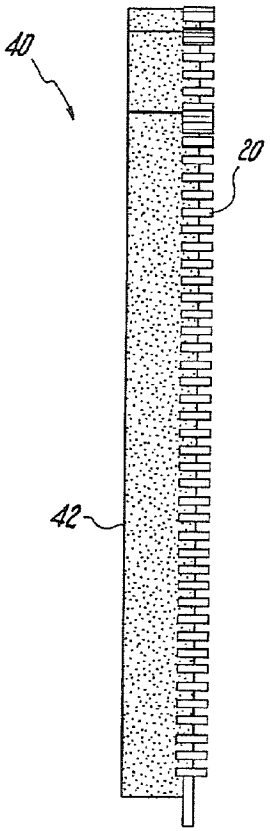
FIG. 9 is a right side elevational view of a zipper portion thereof.

FIG. 9 is a right side elevational view of the palm portion 42 and zipper portion 20. The length of the zipper 20 is determined by the palm size and dimensions. There is a material component and teeth component to the zipper attachment 20, which mates with rear zipper attachment 22 shown in FIG. 1. The material portion gets attached to the palm unit. Optionally the material portion to which the zipper is attached can be a strip of flexible and/or expandable elastic type stretchable material, to permit the palm portion 42 to have greater forward travel during closing or clenching of the hand of the user inside of glove 10. Optionally the strip can vary in width according to the amount of stretch required.

Figure 10:
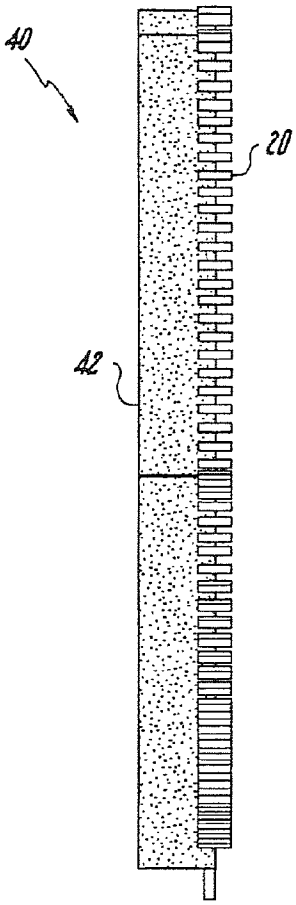
FIG. 10 is a left side elevational view thereof.

FIG. 10 is a left side elevational view of the palm portion 42 and zipper portion 20. The length of the zipper 20 is determined by the palm size and dimensions. There is a material component and teeth component to the zipper attachment 20. The material portion gets attached to the palm unit.

Figure 11:
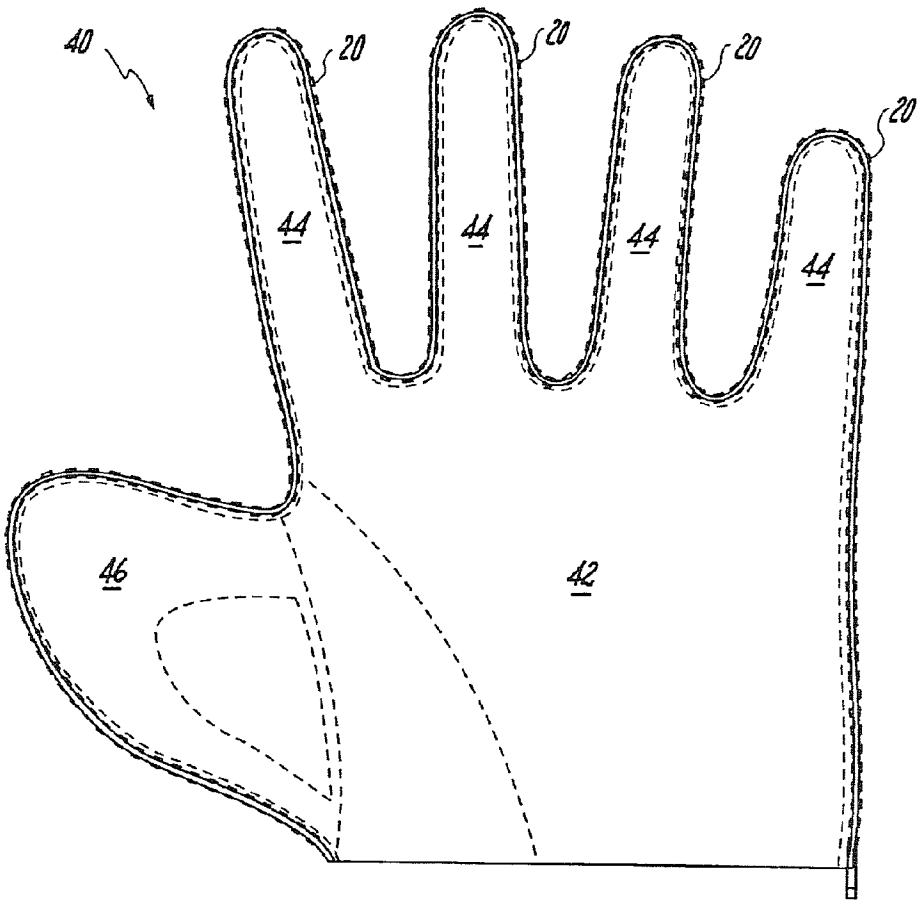
FIG. 11 is a rear elevational view of the other hand of the other embodiment in FIGS. 5-10 for one hand of a pair of zipper-attached front palm units according to the present invention.

FIG. 11 is a rear elevational view of the other hand of the front palm unit 42 of the pair of sports gloves 10, as in FIGS. 5-10 of this invention. The zipper element 20 goes completely around the palm portion 42's periphery.

Figure 11A:
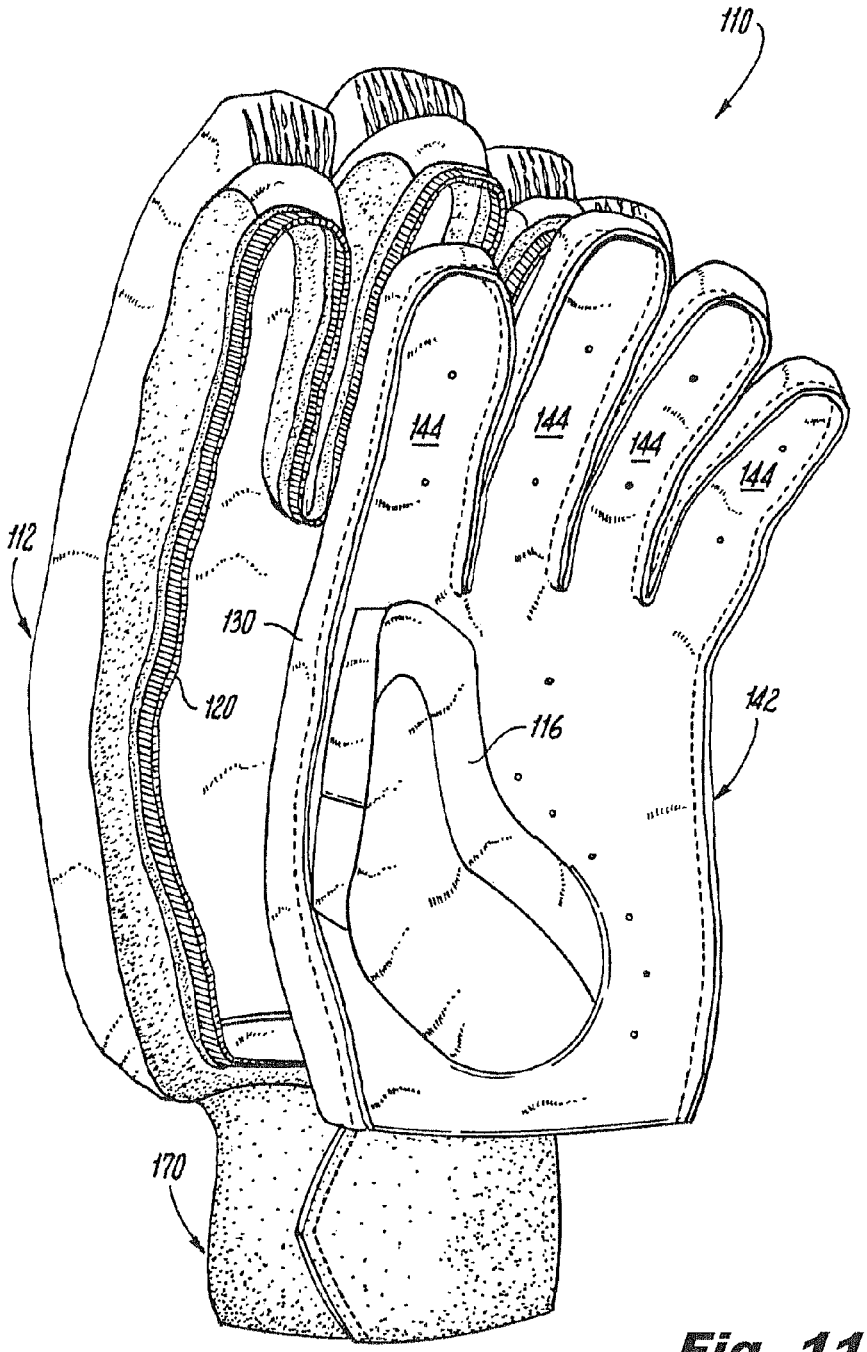
FIG. 11A is a perspective view of an alternate embodiment for a zipper attached sports glove, where the thumb stall protrudes from a surface of the palm portion of the sports glove, and is therefore not connected to a zipper or other connector.

FIG. 11A shows an alternate embodiment for a zipper attached sports glove, such as a cricket glove 110, where the thumb stall 116 protrudes from a surface of the palm portion 142 of the sports glove 110, and is therefore not connected to a zipper 120 or other connector. The zipper 120 connects the front palm portion 142 of the sports glove 110 with the rear portion 112 of the sports glove 110. The zipper 120 is covered by a fly cover 130 wherein the zipper 120 and the fly cover 130 extend in a continuous peripheral non-linear serpentine line of varying radii around each finger stall 144 and side of hand leading toward the cuff 170 on the glove portion and each finger stall and side of hand leading to the cuff on the front palm portion It is further noted that the fly cover 130 may extend front to rear as in FIG. 11A or the embodiment shown in FIG. 2, or from rear to front in an analogous situation as in the embodiment of FIG. 3, or overlapping both from front to back and back to front, as in the embodiment shown in FIG. 4.

Figure 12:
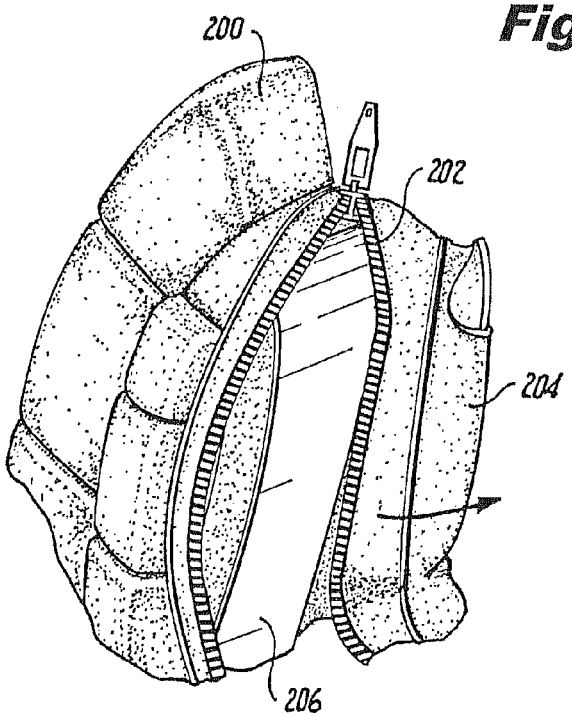
FIG. 12 is a close-up detail perspective view of a padded finger stall showing a barrier finger cushion pad in relation to a zipper which attaches the front and back portions of a sports glove, wherein the novel barrier finger cushion pad is shown added to the finger stall.
Figure 13:
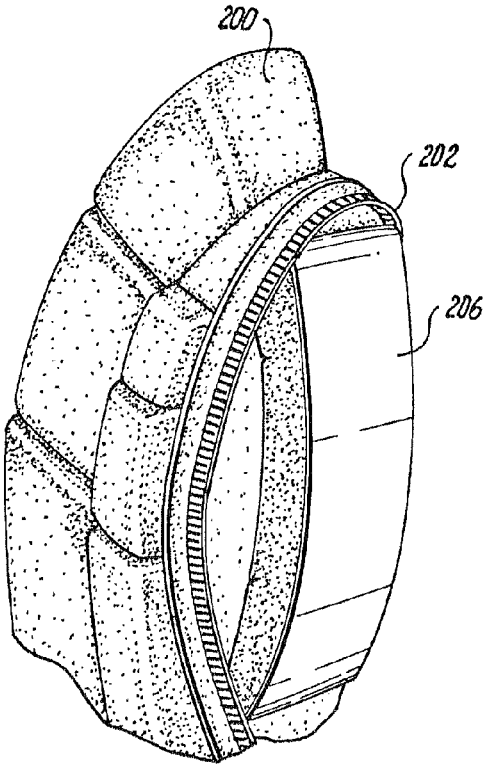
FIG. 13 is a view of the same close-up detail view of the finger stall of FIG. 12 with the front portion of the sports glove removed to obtain a better view of the distal portion of the barrier finger cushion pad.

FIGS. 12 and 13 show close-up details of the distal portion of a single finger stall of an alternate embodiment for a two-part sports glove having a barrier finger cushion pad therein, to isolate the finger tip of the user wearer of the sports glove.

For example, FIG. 12 shows an open abrasive zipper 202 joining the padded back 200 and the front glove finger and palm portion 204 of a sports glove, with a bulging barrier finger cushion pad 206 within. The view of the back portion 200 of FIG. 13 reveals the distal end of the finger protecting barrier cushion pad 206 coinciding with the distal end of the stall cavity.

Figure 14:
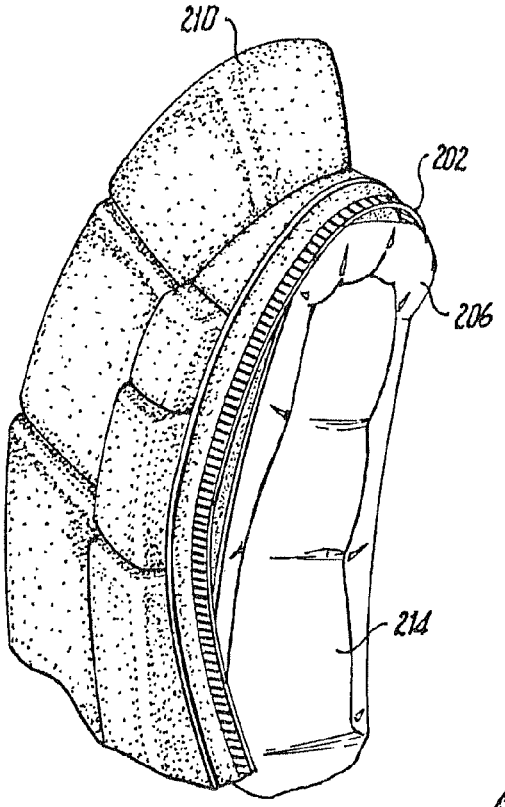
FIG. 14 is a perspective close-up detail view of a finger isolated inside a finger stall in the back portion of a two-part sports glove of FIGS. 12 and 13 of this invention, wherein the finger is isolated by the barrier finger cushion pad from contact with an abrasive zipper attached the front glove finger and palm portion to the rear of the sports glove.

FIG. 14 shows the sports glove of this invention, as in FIGS. 12 and 13 showing the padded back 210. FIG. 14 also shows a finger of the user being isolated by the barrier finger cushion pad 206 from contact with the abrasive zipper 202 attaching the front glove finger and palm portion to the rear of the sports glove. The user's finger 214 is shown within the finger stall surrounded on three sides by the barrier finger cushion pad 206.

Figure 15:
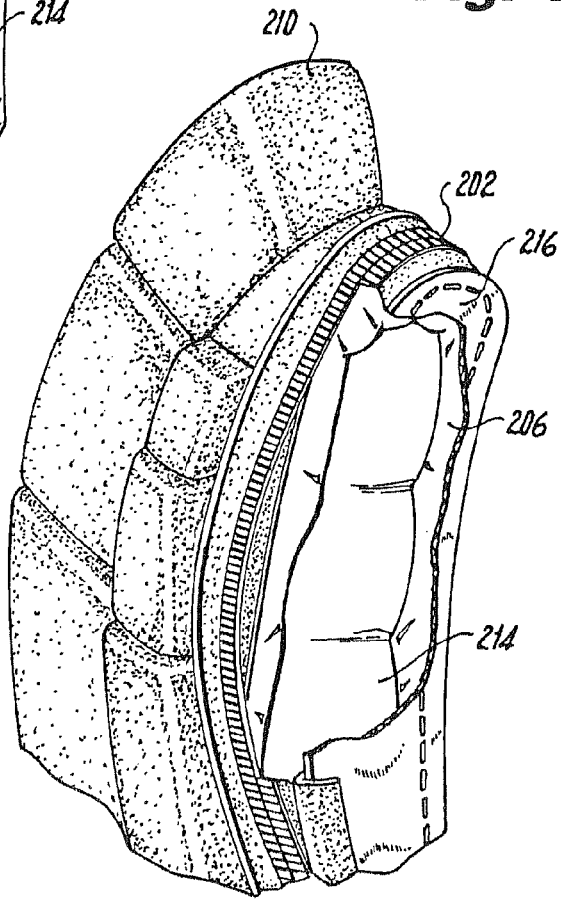
FIG. 15 is a close-up detail view of the barrier finger cushion pad, similar to that shown in FIG. 14 but enhanced with a cutaway shown of the front finger stall portion.

FIG. 15 shows the same view with front glove finger and palm portion 216 attached via zipper 202, showing the user's finger 214 surrounded by the barrier finger cushion pad 206, as seen through the cut-away.

As also shown in FIGS. 12-15, the protective barrier finger cushion pad 206 can also push forward against the rear of the user's finger 214, thereby potentially further isolating the finger 214 of the user, in a forward locational position, so that the finger 214 of the user is advanced forward from the vertical axis of the potentially abrasive zipper 202.

Figure 16:
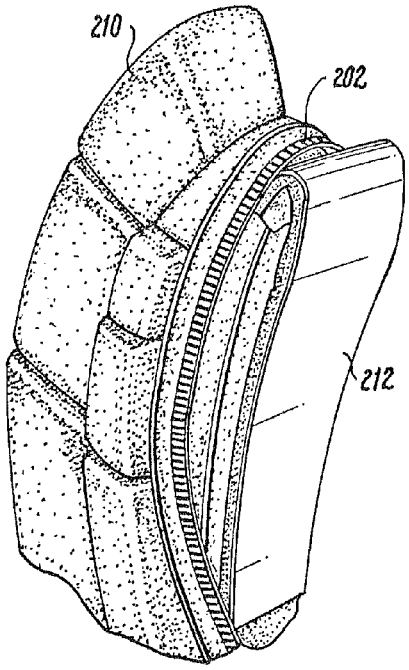
FIG. 16 is a perspective detail view of an alternate embodiment for a barrier finger cushion pad within a finger stall of a sports glove, showing the full length of the folded protective barrier pad within.
Figure 17:
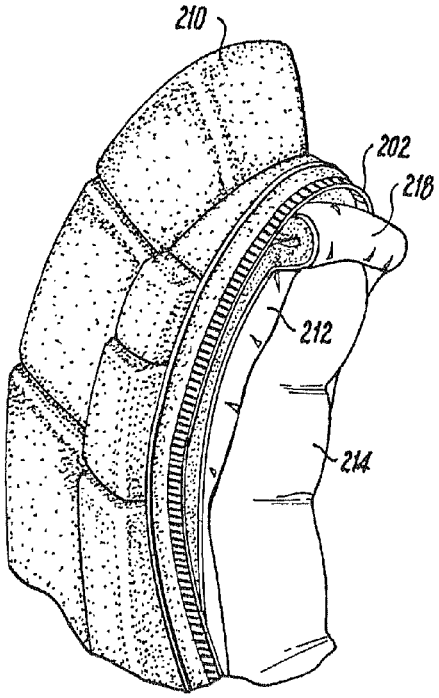
FIG. 17 is a perspective view of the embodiment as in FIG. 16 but with a finger shown in place, showing the fit of the protective barrier pad around the finger within the finger stall of the sports glove.
Figure 18:
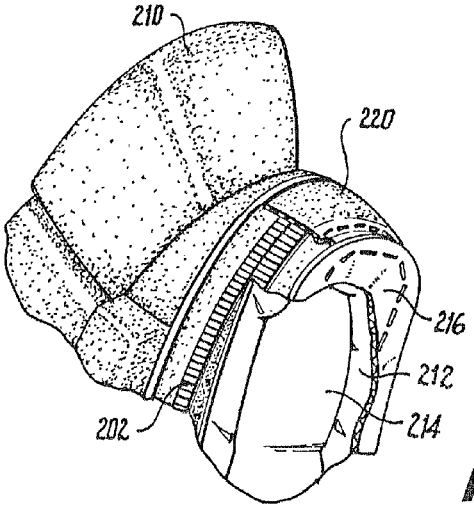
FIG. 18 is a close-up detail perspective view of the distal tip of a finger within the finger stall shown in FIGS. 16 and 17, with the front glove finger and palm portion shown in partial cut-away.

The sequence of FIGS. 16 through 18 shows an alternate embodiment for a protective barrier finger cushion pad in detail with clarity.

For example, FIG. 16 shows that pad 212 includes two layers folded over at the upper distal end.

With the user's finger inserted in a finger stall as shown in FIG. 17, it is noted that protective barrier pad 212 rolls over the top of the fingertip of the user's finger 214, forming a soft bolster 218. It is noted here in FIG. 17, as in FIG. 18, that protective barrier finger cushion pad 212 also wraps around the sides of finger 214 to prevent any touching of zipper from the inside. It is noted that bolster 218 totally prevents any fingertip/zipper abrasive contact. Protective barrier finger cushion pad 212 can also push forward against the rear of the user's finger 214, thereby potentially further isolating the finger 214 of the user, in a forward locational position so that the finger 214 of the user is advanced forward from the vertical axis of the potentially abrasive zipper.

FIG. 18 also shows optional outer flap cover 220 which precludes contact of other players with the potentially abrasive exterior of zipper 202 during play.

FIGS. 19-21 show details of a further alternate embodiment for a protective wrist cuff extension of this invention.

For example, a sports-glove with a padded rear section 210 and front glove finger and palm portion 216 is shown in FIG. 19 with an attached wrist cuff extension 222.

For example, FIG. 20 reveals hook and loop Velcro® attachment strips (labeled as reference numeral 226 on the front glove finger and palm portion 216 of the sports glove and as reference numeral 224 on the inside of the back of cuff extension 222), as well as pivotable flap 228. Flap 228 tucks into the glove when donning to provide a smooth surface in contact with the inner wrist.

The final position of the various parts is shown in the crossectional view of FIG. 21. It is noted that pivotable flap 228 ends up against the inside surface of glove palm base lower portion 216, thereby creating a smooth transition shielding cavity 230 from any contact with sensitive skin of the glove's user. Thus the edge of front palm 216 as well as hook and loop Velcro® fasteners 224 and 216 are bypassed from skin contact while donning the sports glove, or during play.

Figure 22:
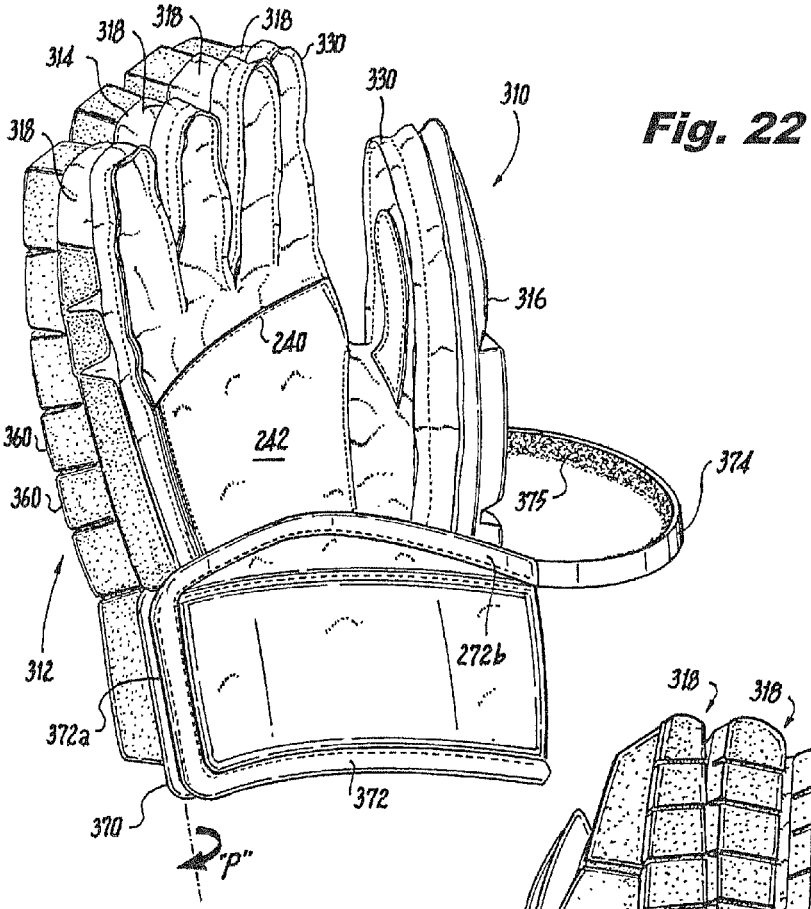
FIG. 22 a front perspective of another embodiment of the zipper attached sports glove showing a distal fastener strip extended outward from a pivotable front cuff portion, which is pivotable in the directional arrow "p", when loosening and taking apart the glove.
Figure 23:
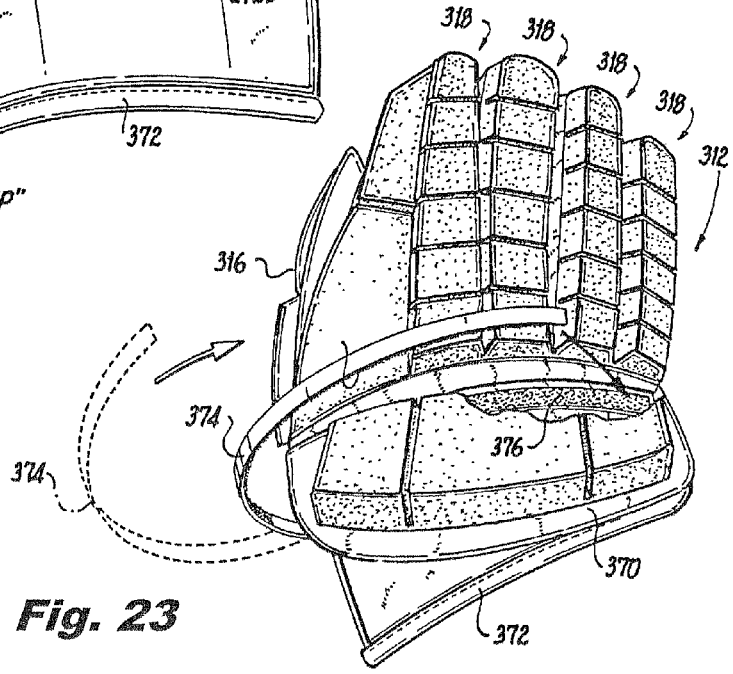
FIG. 23 is a rear perspective view showing the pivoting flap and fastener strip being wrapped around and being inserted into a top edge of the rear, partially fixed, flexible cuff of the hockey glove, for tightening against the glove and exerting pressure against the portion of the fly cover in the vicinity of the zipper pull tab, to facilitate the grasping and close covering of the fly cover over the zipper connecting the front and rear portions of the sport's glove together.

FIGS. 22 and 23 show in an alternate embodiment for a sports glove 310, having front palm portion 342 having periphery 340 above which extend finger stalls 318 and thumb portion 316, as well as connectable rear back portion 360 with finger stalls, each connected by a connector, such as zipper 320 having pull tab 320*a*. The zipper 320 is optionally covered by fly cover 330, which grasps and closely covers zipper 320. Glove 310 also has front pivotable cuff portion 372, pivotable about edge 372*a*, as well as a distal end fastener strip 374 having a hook and loop type fastener 375, which is wrapped around partially fixed, flexible rear back cuff portion 370, which as shown in FIG. 23, is inserted into an open top edge of rear cuff 370 having a reciprocal hook and loop fastener 376 therein. wherein the back portion 360 and the front palm portion 342 are attached together by the zipper 320's two parts being respectively on the front palm portion 342 and the back portion 360, the zipper 320 being optionally covered by the fly cover 330. The pivotable cuff 372 and fastener strip 374 exert pressure on the zipper tab handle 320*a* portion and the portion of the optional fly cover 330 thereat, to prevent exposure of the zipper to the skin of the players playing a game, such as hockey, and to facilitate the grasping and close covering of the fly cover over the zipper connecting the front and rear portions of the sport's glove together.

FIG. 22 shows the pivoting cuff 372 and fastener strip 374 being wrapped around the rear cuff 370 and being inserted into an open top edge of the rear, partially fixed, flexible cuff 370 of the hockey glove 310, for tightening against the glove 310 and exerting pressure against the portion of the fly cover 330 in the vicinity of the zipper pull tab 320*a*, to further facilitate the grasping and close covering of the optional fly cover 330 over the zipper 320 connecting the front portion 342 and rear portion 360 of the sport's glove 310 together. The fastener strip 374 can alternatively go from the pivotable cuff portion 372 and grasp any portion of the glove adjacent to the pivotable cuff portion 372 when closed.

FIG. 23 shows finger padded rear portion 360 of the glove of FIG. 22, showing the distal fastener strip 374 with hook and loop portion 375 extended outward from pivotable front cuff portion 372, which is pivotable in the directional arrow "p" shown in FIG. 22, and attachable with hook and loop fastener strip 376 within rear partially fixed, flexible cuff portion 370.

It is known to those skilled in the art, that the pivoting of the cuff can pivot from below the pinky finger area and wrap around the glove to the area below the thumb, as in FIGS. 22 and 23, or can pivot elsewhere, such as below the thumb and wrap around the glove to the area below the pinky, as in FIGS. 19 and 20, with or without the pivotable flap 228 shown in FIG. 19. The configurations of the glove with the pivotable cuff can also accommodate right handed users or left handed users.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

The invention claimed is:

1. A sports glove, used in a sports event by a sport participant holding an item during game play, comprising:

a front palm portion having front finger stall regions for insertion of fingers therein;

a back joinable glove portion attachable to said front palm portion by a closure, in a closed position during use of the glove during game play, said back joinable glove portion having corresponding rear finger stall regions joinable by said closure;

said front and rear finger stall regions forming hollow finger stalls for insertion of fingers therein;

said closure being a zipper having corresponding connecting parts with zipper teeth, each corresponding zipper part joinable to said front palm portion or to said back joinable glove portion, forming an exposed abrasive zipper extending in vertical axes on the inside walls and respective fingertip top walls of said finger stalls;

a protective barrier of at least one proportioned protruding padding cushion located inside said finger stalls capable of insulating each finger side and distal fingertip end from contact with the closure, thereby offering adequate protection thereto.

2. The sports glove as in claim 1 wherein said protective barrier of said at least one proportioned protruding padding cushion is a bulging barrier finger cushion pad.

3. The sports glove as in claim 2 wherein said a distal end of said bulging barrier finger cushion pad coincides with the distal end of each said stall cavity.

4. The sports glove as in claim 1 wherein a user's finger capable of being inserted within a respective finger stall of said sports glove being surrounded on three sides by said barrier finger cushion pad.

5. The sports glove as in claim 1 wherein said protective barrier finger cushion pad capable of being pushed forward against a rear of the user's finger, thereby further isolating the finger of the user, in a forward locational position, so that the finger of the user is advanced forward from a vertical axis of said abrasive teeth of said zipper closure.

6. The sports glove as in claim 1 wherein said protective barrier cushion pad includes two layers folded over at an upper distal end thereof.

7. The sports glove of claim 1 wherein said finger stalls further comprise a thumb finger stall.

8. The sports glove of claim 1 wherein said finger stalls do not include a thumb stall, wherein further said thumb stall protrudes separately outward from said front palm portion.

9. A sports glove, used in a sports event by a sport participant holding an item during game play, comprising:

a front palm portion having front finger stall regions for insertion of fingers therein;

a back joinable glove portion attachable to said front palm portion by a closure, in a closed position during use of the glove during game play, said back joinable glove portion having corresponding rear finger stall regions joinable by said zipper;

said closure being a zipper having corresponding connecting parts with zipper teeth, each corresponding zipper part joinable to said front palm portion or to said back joinable glove portion, forming an exposed abrasive zipper extending in vertical axes and rounded over respective tops of said finger stalls;

said front and rear finger stall regions forming hollow finger stalls for insertion of fingers therein; and, a pivotable inside wrist cuff flap provided on an inside portion area of the front cuff of said sports glove, said pivotable inside wrist cuff flap providing a smooth transition of inside smooth liner material capable of protecting the skin of the user's the palm and inside wrist from contact with closure materials in the inside cuff portion area as the user's hand is inserted into the glove.

10. The sports glove as in claim 9 wherein said pivotable inside wrist cuff flap tucks into the glove when the user is donning the glove, to provide a smooth surface capable of being in contact with the skin of the inner wrist of the user.

11. The sports glove as in claim 10 wherein said pivotable inside wrist cuff flap ends up positioned against an inside surface of the sports glove's respective palm base lower portion, thereby creating a smooth transition capable of shielding the skin of the wrist of the user from any contact with an edge of said front palm portion and respective interior hook and loop fasteners while the user dons the sports glove, or during game play.

12. The sports glove of claim 9 wherein said finger stalls further comprise a thumb finger stall.

13. The sports glove of claim 9 wherein said finger stalls do not include a thumb stall, wherein further said thumb stall protrudes separately outward from said front palm portion.

14. The sports glove of claim 9 wherein said closure material inside said inside cuff portion is hook and loop fasteners.

15. A sports glove used in a sports event by a sport participant holding an item during game play, comprising:

a front palm portion having front finger stall regions for insertion of fingers therein;

a back joinable glove portion attachable to said front palm portion by a closure, in a closed position during use of the glove during game play, said back joinable glove portion having corresponding rear finger stall regions joinable by said zipper;

said closure being a zipper having corresponding connecting parts with zipper teeth, each corresponding zipper part joinable to said front palm portion or to said back joinable glove portion, forming an exposed abrasive zipper extending in vertical axes on both sides and rounded over respective tops of said finger stalls;

said front and rear finger stall regions forming hollow finger stalls for insertion of fingers therein;

wherein the fingers inserted inside the finger stalls are protected from contact with the zipper by proportioned padding provided inside said finger stalls insulates each finger side and distal end from contact with the zipper; and, a pivotable inside wrist cuff flap being provided, said pivotable inside wrist cuff flap providing a smooth transition of inside smooth liner material capable of protecting the palm and inside wrist of the user from contact with closure material in the inside cuff portion area as the user's hand is inserted into the glove.

16. The sports glove of claim 15 wherein said finger stalls further comprise a thumb finger stall.

17. The sports glove of claim 15 wherein said finger stalls do not include a thumb stall, wherein further said thumb stall protrudes separately outward from said front palm portion.

18. The sports glove of claim 15 wherein said closure material inside said inside cuff portion is hook and loop fasteners.

19. A sports glove, used in a sports event by a sport participant holding an item during game play, comprising:

a front palm portion having finger stalls for insertion of fingers therein;

a rear back joinable glove portion attachable to said front palm portion by a zipper, in a closed position during use of the glove during game play;

said front palm portion covered by a pivotable cuff portion attached to said rear back joinable glove portion at a side edge thereof;

said rear back joinable portion further having a partially fixed, flexible cuff portion; wherein said pivotable cuff portion pivots over a wrist portion of said front palm portion;

said front pivotable cuff portion being tightened against said rear back glove portion with a distal fastener strip extending from said pivotable cuff portion and closely grabbing any portion of said rear back glove portion.

20. The sports glove as in claim 19 wherein said fastener strip optionally extends from a distal leading edge of said pivotable cuff portion into a top edge between said rear partially fixed, flexible cuff portion and said rear back glove portion of said glove.

21. The sports glove as in claim 19 wherein said zipper is covered by a fly cover.

22. The sports glove as in claim 19 wherein said zipper is exposed on the outside of the sports glove.

* * * * *